US005947477A

United States Patent [19]

Turnipseed

[11] Patent Number: 5,947,477

[45] **Date of Patent: *Sep. 7, 1999**

[54] BREAKDOWN SHOOTING TARGET

[76] Inventor: Kent Turnipseed, 9800 Topanga Canyon Blvd., # 192, Chatsworth, Calif. 91311

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,847

[22] Filed: Mar. 7, 1997

[51] Int. Cl.[6] ..... F41J 1/10

[52] U.S. Cl. ..... 273/407; 273/359

[58] Field of Search ..... 273/406, 407, 273/400, 401, 402, 396, 359; 473/454

[56] References Cited

U.S. PATENT DOCUMENTS

| | | | |
|---|---|---|---|
| 1,364,010 | 12/1920 | Tyerman | 273/407 |
| 2,722,420 | 11/1955 | Adamson | 273/407 |
| 3,312,467 | 4/1967 | Dawson | 473/454 |
| 3,415,519 | 12/1968 | Hand | 273/407 |
| 4,330,129 | 5/1982 | Meredith | 273/407 |
| 4,433,843 | 2/1984 | Bricco | 273/407 |
| 4,629,188 | 12/1986 | Mahieu | 273/407 |
| 4,811,956 | 3/1989 | Foreman | 273/407 |
| 4,842,284 | 6/1989 | Rushing et al. | 273/407 |
| 5,209,492 | 5/1993 | Hamilton | 273/407 |

FOREIGN PATENT DOCUMENTS

| | | | |
|---|---|---|---|
| 94015166 | 7/1994 | WIPO | 273/407 |

*Primary Examiner*—Mark S. Graham
*Attorney, Agent, or Firm*—Bruce A. Jagger

[57] ABSTRACT

A hand assembleable target stand formed by generally elongated frame members joined together into a generally planar target mounting assembly through connector units which define the corners of the assembled frame member. The target mounting assembly is hand assembleable to base units which, when assembled, project generally normal to the plane of the target mounting assembly. A disposable target is provided with stiffening members at its outer opposed margins. The stiffening members are adapted to being clamped to the target mounting assembly so as to hold the disposable target assembled with the target stand. In the disassembled configuration the target stand and the disposable target form a very compact package which is easily transported by one person, and stored in a very small volume. The base unit may be a remote controlled, self propelled mobile unit, if desired.

7 Claims, 5 Drawing Sheets

BREAKDOWN SHOOTING TARGET

BACKGROUND OF THE INVENTION

1. Field of the Invention

The invention relates in general to shooting targets and, in particular, to rugged, stationary and mobile shooting targets which may be easily broken down for transportation and storage, and assembled with the target in more than one configuration.

2. Description of the Prior Art

Previous expedients have included immobile shooting targets which were not durable (for example, Hamilton U.S. Pat. No. 5,209,492, and Trachet U.S. Pat. Des. No. 333,683, with a PVC frame which shatters when hit by a bullet and does not breakdown for transportation and storage), were heavy, did not breakdown into easily portable segments, were expensive to manufacture, and required tools to assemble (for example, Bateman U.S. Pat. No. 5,277,432), were constructed of wood and did not breakdown into easily portable segments (for example, Hand U.S. Pat. No. 3,415,519), or did not breakdown into easily portable segments (for example, Scholem U.S. Pat. No. 4,691,925). Further, previous expedients generally did not provide mobile self propelled and self powered, remote controlled targets. Also, previous expedients generally did not provide optional configurations utilizing the same components, for example, both high and low profile targets.

These and other difficulties of the prior art have been overcome according to the present invention.

BRIEF SUMMARY OF THE INVENTION

A preferred embodiment of the shooting target stand according to the present invention comprises a generally planar target mounting assembly mounted on at least one base unit. The target mounting assembly is generally hand assembleable from individual components which, in the disassembled form, including the target itself, are lightweight and very compact. The target mounting assembly is generally hand assembleable to at least one base unit which is adapted to support the assembly in a generally upright position. The assembly, even though hand assembleable, is rigid and durable. The target mounting assembly generally provides alternative high and low profiles, just by selecting which components to combine.

The target supporting assembly generally includes at least one frame member, at least two connecting units, and at least one target mounting member. For a high profile target supporting assembly, the assembly preferably includes at least four frame members, four connector units, and two target mounting members. According to one preferred embodiment, the connector units are separate components which assemble together with the frame members by means of slip fit joints. As will be understood by those skilled in the art, the connector units may be integral, in whole or in part, with the frame members, so long as the assembly can be broken down into components which, when bundled together in the disassembled form, comprise a compact package. The target mounting members are generally positioned on either side of the assembled target supporting assembly, and serve to clamp the unfolded target to the assembly in the desired high or low profile.

The target itself is disposable, and is foldable along fold lines which provide a compact component of a size and configuration which is compatible and generally approximately co-extensive with the size and configuration of the disassembled target support assembly. In general the target includes some panels which in the unfolded configuration define the target area, and some reinforcing members which generally hold the target to the support assembly in its unfolded configuration. In general, the edges of the target panels are attached, for example, by stapling, to lath or other disposable straight reinforcing members. The lath are then clamped by the target mounting members to the assembly. The mounting of the assembly to the base units completes the construction of the target stand.

The base units include both stationary and mobile supports. The base units generally include elongated elements which project generally laterally, for example, normal, to the plane of the target. The target is thus supported in a generally upright position. For improved stability, the elongated feet elements in a pair of base units extend generally on both sides of the target, but for different distances. Thus, for example, the elongated element in one base unit may project twice as far from the plane of the target element on the first side of the target stand as on the second side. The configuration can be reversed for the other base unit so that the second elongated element extends twice as far from the second side of the target element as it does from the first side.

BRIEF DESCRIPTION OF THE DRAWINGS

Referring particularly to the drawings for the purposes of illustration and not limitation.

DETAILED DESCRIPTION OF THE PREFERRED EMBODIMENTS

Figure 5:
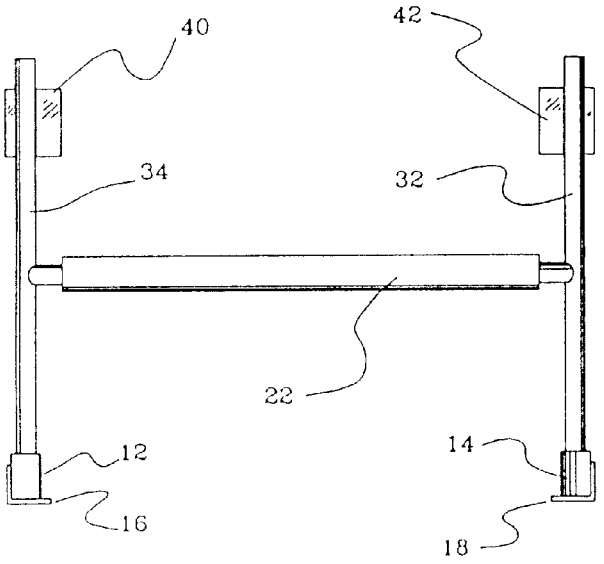
FIG. 5 is a front elevational view of an embodiment of this invention showing a target stand configured for a low profile target.
Figure 2:
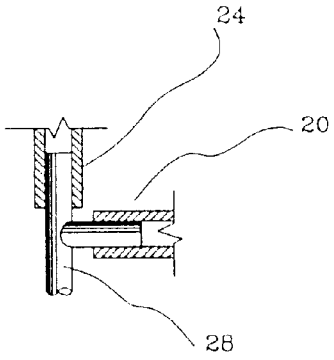
FIG. 2 is a broken cross-sectional view taken along line 2—2 of FIG. 1 showing a connector unit at a corner of the target stand.
Figure 1:
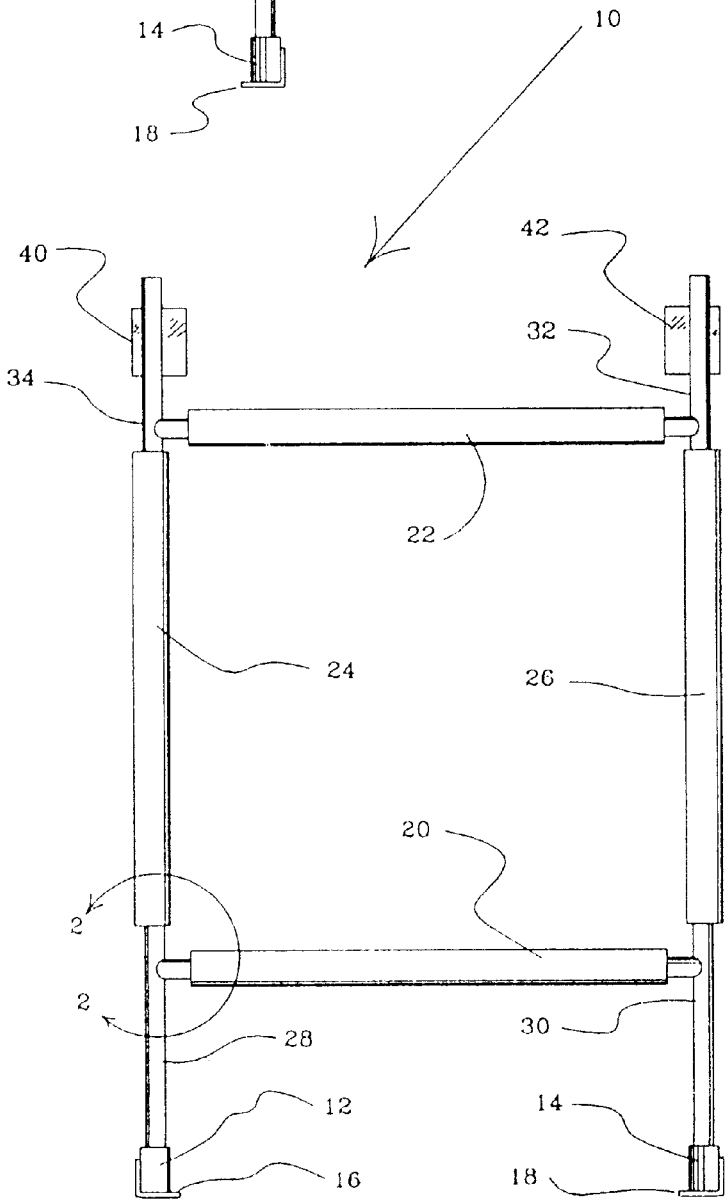
FIG. 1 is a front elevational view of a preferred embodiment of the invention showing a target stand configured for a high profile target.

Referring particularly to the drawings, where the same reference numbers are used in different Figures for similar features, there is illustrated generally at 10 a hand assembleable target stand. In the preferred embodiment which has been selected for purposes of illustration, base units 12 and 14 include elongated feet elements 16 and 18, respectively. Normally horizontal frame members 20 and 22, together with normally vertical frame members 24 and 26, define a generally planar rectangular frame. The respective frame members are assembled together through connecting units 28, 30, 32, and 34. As illustrated, for example, in FIG. 2, the frame members are conveniently assembled together through slip fit socketing with a connecting unit.

Figure 6:
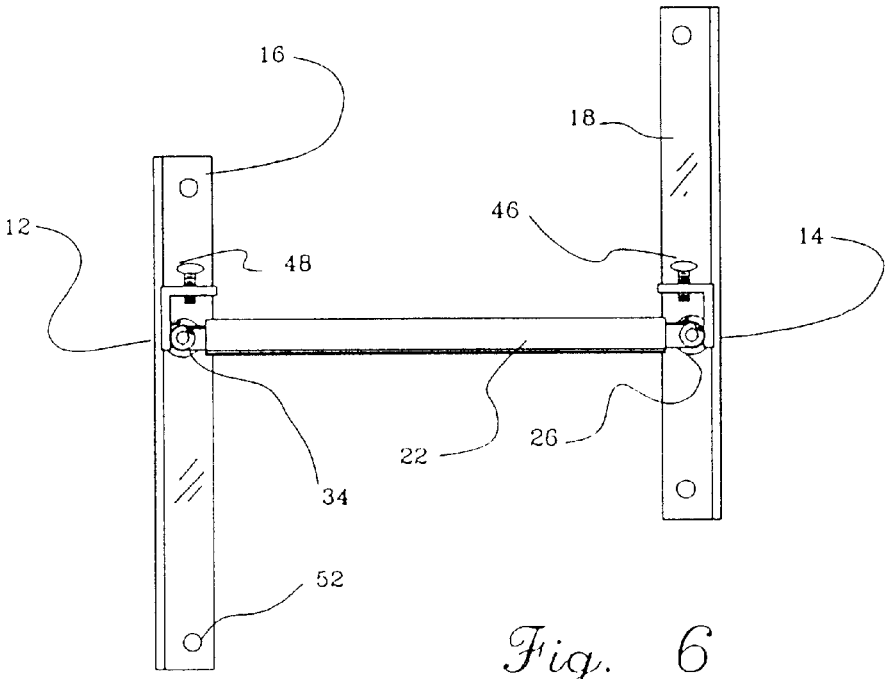
FIG. 6 is a plan view of the embodiment of FIG. 1.

The elongated feet elements 16 and 18, in the assembled configuration project generally normal to the plane defined by the target mounting assembly. Stability is achieved by reason of several different features. The elongated feet elements generally are not disposed symmetrically with respect to the plane of the target mounting assembly, for example, one preferably projects further than the other on opposite sides of the target mounting assembly. See, for example, FIG. 6. Holes, for example, 52, can be provided for anchoring the elongated feet elements to a supporting substrate. Generally, the elongated feet elements are assembled to the target stand through slip fit joints with the connecting units.

Figure 3:
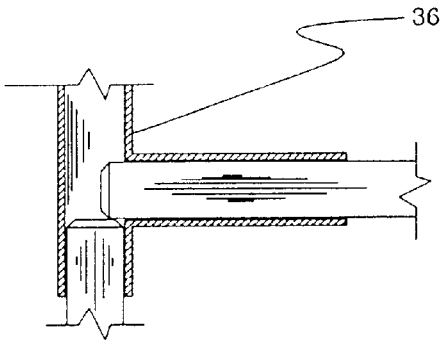
FIG. 3 is a view similar to FIG. 2 of an additional embodiment of a connector unit.
Figure 4:
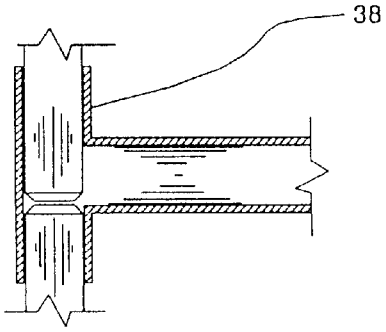
FIG. 4 is a view similar to FIG. 2 of a further embodiment of a connector unit.

The connecting units, according to one preferred embodiment, form the corners of the target stand, and are separable from the generally elongated frame members. As illustrated, for example, in FIGS. 3 and 4, the connecting units 36 and 38, which define the corners of the frame, may be integral with one of the frame members so long as they do not prevent the frame from being broken down into a compact, easily transportable package. In general, it has been found that the provision of the preferred separate connecting units facilitates the easy selection and assembly of either a high or low profile target stand from the same elements.

The frame members are generally round and tubular, however, generally rectangular or solid members, or frame members of other configurations may be used, if desired. Generally rectangular frames with four sides are conveniently assembled, however, as will be understood by those skilled in the art, other frame shapes such as triangular, pentagonal, hexagonal, or the like, may be used, if desired. In general, the frames members define a generally planar target mounting assembly. The frame members in low profile target mounting assemblies may only define, for example, three of the four sides of a rectangular target mounting assembly.

The target mounting assembly preferably includes target mounting members 40 and 42, by means of which a disposable target, indicated generally at 44, can be mounted to the target stand 10. The target mounting members 40 and 42 include, for example, thumbscrews 46 and 48, respectively, threadably mounted in a bracket so as to bear threadably against an edge of the disposable target 44. The opposed edges of the disposable target are thus conveniently trapped between the respective thumb screws and the adjacent structure of the target mounting assembly, for example, the adjacent connecting units.

Figure 10:
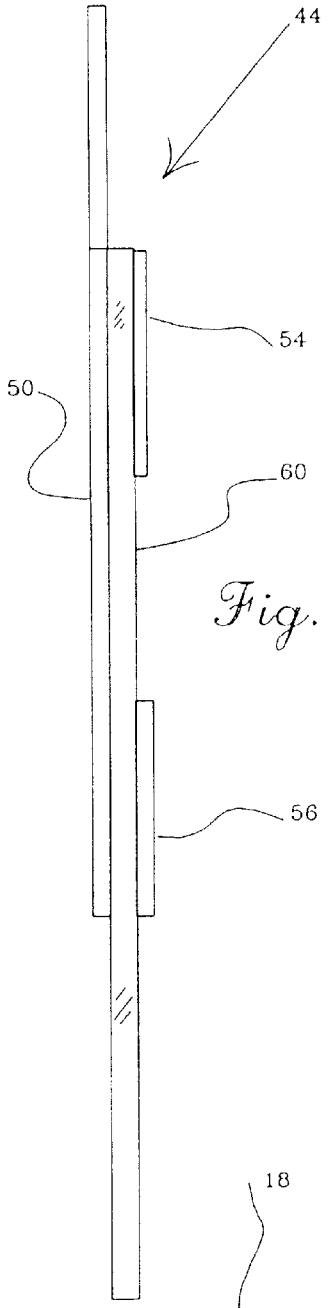
FIG. 10 is a side elevational view of a disposable target.
Figure 7:
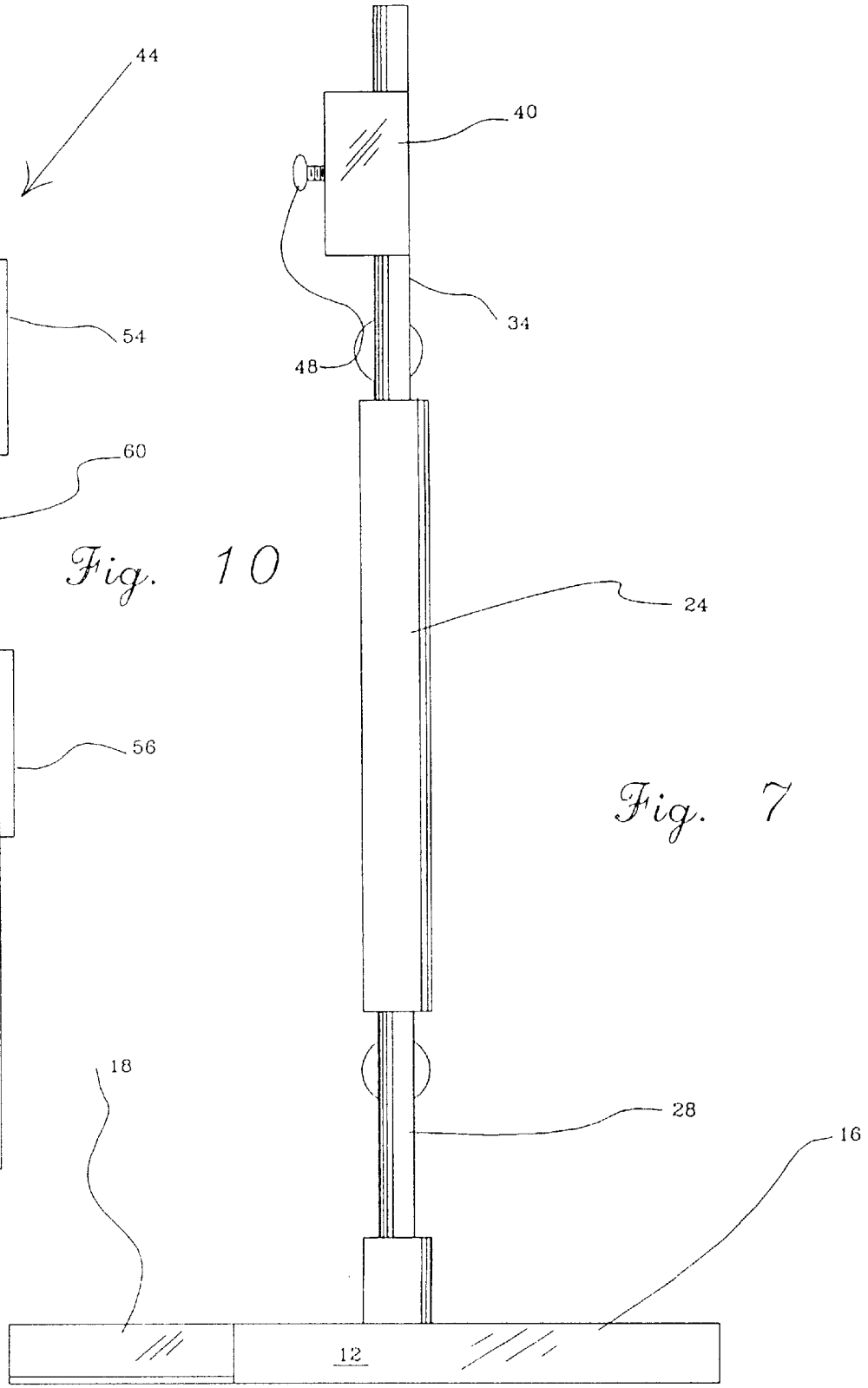
FIG. 7 is a side elevational view of the embodiment of FIG. 1.
Figure 9:
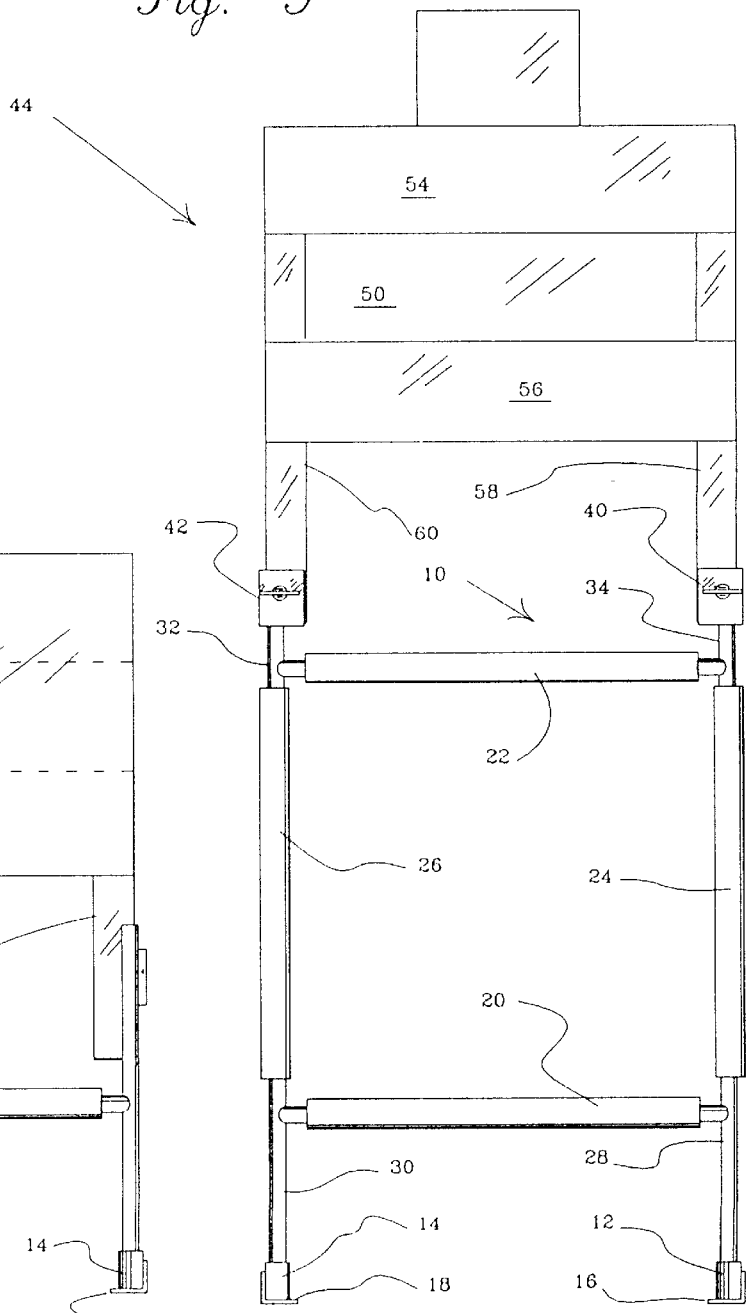
FIG. 9 is a front elevational view of the target stand of FIG. 1 showing a disposable target mounted in a high profile configuration.
Figure 8:
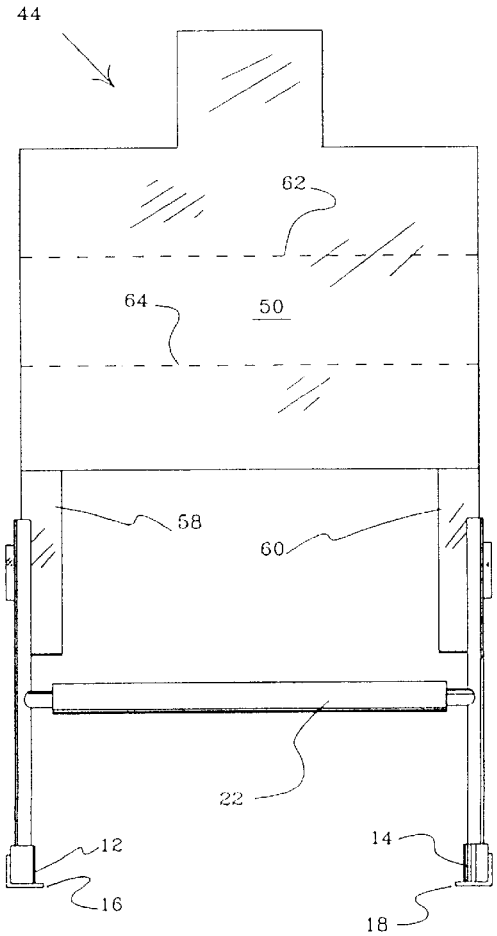
FIG. 8 is front elevational view of the target stand of FIG. 5 showing a disposable target mounted in a low profile configuration.

Disposable target 44 is constructed, for example from disposable cardboard target panels 50, 54 and 56. See, for example, FIGS. 8, 9 and 10. These target panels are mounted at their outer margins, for example, to disposable wooden or plastic strips, 58 and 60. These strips are rigid so that they hold the panels in the desired planar configuration. The target panels are fastened to the reinforcing members 58 and 60 by staples, adhesive, or the like.

Generally, the target panels are assembled to the reinforcing members at the site of use, and are disposed of after use. They are preferably not transported or stored in the assembled configuration. The smaller panels 54 and 56 generally serve to reinforce the assembled target panel. The face or front panel 50 is preferably presented to the shooter. The large panel 50 is preferably provided with fold lines 62 and 64 so that it may be folded down into a relatively compact package.

Figure 12:
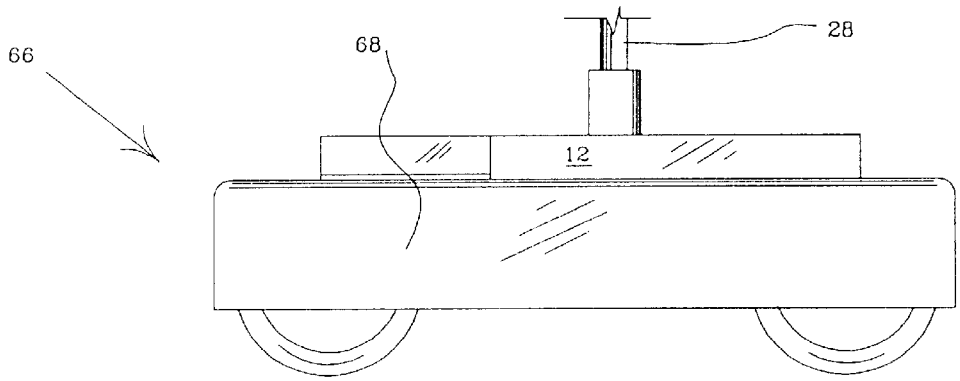
FIG. 12 is a partial side elevational view of the embodiment of FIG. 11.
Figure 11:
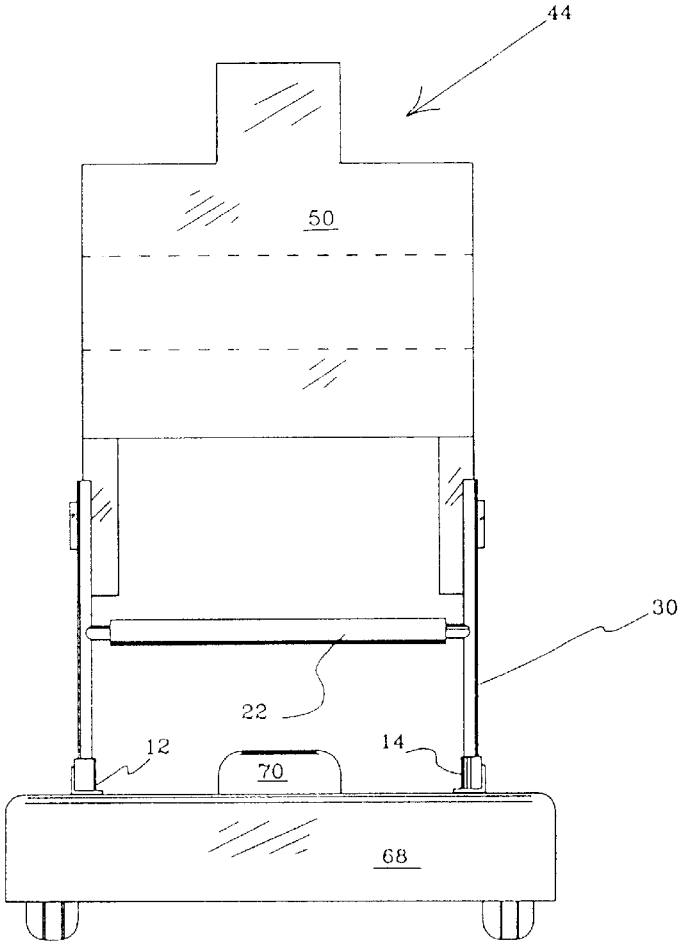
FIG. 11 is a front elevational view of a low profile target stand and disposable target mounted on a mobile base unit according to the present invention.

A mobile base unit, indicated generally at 66, comprises a generally bullet proof shroud 68, a conventional propulsion unit and power source within the shroud (not shown), and sensor unit 70 which is adapted to receive control instructions from a remote source. See, for example, FIGS. 11 and 12. The mobile unit 66 is adapted to carry a target stand, for example, the target stand of the present invention, along an erratic course at varying rates of speeds according to the directions of a remotely located operator.

Mobile unit 66 is remotely controlled and self propelled. Preferably the power source for the mobile unit is a battery which is contained within the shroud. Preferably, there are no wires trailing the mobile unit. Being exposed to live fire, such trailing wires tend to become damaged. Thus, the propulsion is preferably completely self contained, and the remote control is provided by radio transmission or the like. If desired, the mobile base unit may be pre-programed to follow a particular pre-defined path so that the remote control is provided prior to the launch of the mobile base rather than while it is in motion.

In the embodiment chosen for illustration, mobile unit 66 is shown with wheels. As will be understood by those skilled in the art, treads, and the like, could also be employed, if desired. The wheels are somewhat exposed to bullets, so they are preferably composed of steel, or the like. Steering may be provided by differential drive on the wheels, or by conventional steering linkages, or the like.

Both for purposes of compactness and protection of the device, the mobile base unit preferably has a generally low profile and a footprint which is approximately the same as that of the stationary embodiment. This permits the mobile base unit to be transported and stored in a relatively small package. When coupled with the hand disassemblable target stand of the present invention, a very sophisticated target system can be easily transported by one person, and stored in a very small volume.

The target stand according to the present invention can be quickly assembled and disassembled by hand without the aid of any tools. When disassembled, the target stand is preferably composed of elongated members which are generally no more than approximately 2 feet in length, some of which have short projections or stubs extending laterally thereof for approximately 2 inches. According to one preferred embodiment, the components of the target stand are all assembled together through slip fit joints. According to one preferred embodiment, the entire target stand disassembles into a bundle of loose elongated components approximately 6 inches in diameter and 2 feet long. The components of the disposable target are likewise very compact, particularly when face panel 50 is folded along fold lines 62 and 64.

What has been described are preferred embodiments in which modifications and changes may be made without departing from the spirit and scope of the accompanying claims.

What is claimed is:

1. A target stand comprising:

a generally planar target mounting assembly having at least two corners, said generally planar target mounting assembly including at least one generally elongated frame member, a plurality of connecting units, and two target mounting members, said target mounting members being disposed generally on opposed edges of said generally planar target mounting assembly, and a disposable target, said disposable target including a generally planar target panel and a pair of reinforcing members disposed on generally opposed edges of said planar target panel, said disposable target being adapted to being mounted to said generally planar target mounting assembly by said target mounting members releasably engaging with said reinforcing members, said generally elongated frame member and said connecting units defining therebetween male and female elements to form generally rigid, hand releasable slip fit socketed joints, said generally planar target mounting assembly being adapted to being releasably assembled from said connecting units, frame member and target mounting member by mating said male and female elements together, said corners being formed by said connecting units; and at least one generally T-shaped base unit including a slip fit joint element defining the leg of said T-shape, and adapted to support said generally planar target mounting assembly in a generally upright position through a slip fit socketed joint with at least one of said connecting units.

2. The target stand of claim 1 wherein said generally planar target panel comprises at least two panes joined along a fold and adapted to being compacted by being folded along said fold into a generally planar package, said generally planar target panel being adapted to being held in an unfolded configuration by said reinforcing members.

3. The target stand of claim 1 wherein said generally T-shaped base unit(s) further comprise a remote controlled self propelled mobile unit.

4. The target stand of claim 3 wherein said target stand is adapted to being releasably mounted to said mobile unit in a generally upright position through at least one hand releasable slip fit socketed joint with a said connecting unit.

5. A target stand comprising:

a generally planar target mounting assembly having at least two generally square corners, said generally planar target mounting assembly including at least one generally elongated frame member having two ends, each end of said generally elongated frame member including a female frame slip fit joint member, at least two connecting units, and at least one target mounting member, said corners being formed by said connecting units, each of said connecting units including at least two male connecting slip fit joint members, each of said connecting slip fit joint members being adapted to mate with a frame slip fit joint member, whereby said connecting units are adapted to being hand releasably assembled to said frame member through said respective slip joint members to form said generally planar target mounting assembly, said target mounting member being mounted on one of said connecting units; and at least two generally T-shaped base units, each of said generally T-shaped base units including an elongated foot element adapted to extend generally parallel with a supporting surface and to support said generally planar target mounting assembly in a generally upright position from a location intermediate the ends of said elongated foot element through a releasable slip fit socketed joint with one of said connecting units, said elongated foot elements being adapted to rest on a generally flat surface, and to project generally normal to said generally planar target mounting assembly, and said elongated foot elements being adapted to project for different distances from said generally planar target mounting assembly.

6. The target stand of claim 5 wherein said generally T-shaped base units further comprise a remote controlled self propelled mobile unit.

7. The target stand of claim 6 wherein said target stand is adapted to being releasably mounted to said mobile unit in a generally upright position through at least one hand releasable slip fit socketed joint with a said connecting unit.

* * * * *